US008577273B2

(12) United States Patent
Inoue

(10) Patent No.: US 8,577,273 B2
(45) Date of Patent: Nov. 5, 2013

(54) IMAGE FORMING APPARATUS HAVING SHEET COOLING DEVICE

(75) Inventor: Kozo Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/831,986

(22) Filed: Jul. 7, 2010

(65) Prior Publication Data

US 2011/0008087 A1 Jan. 13, 2011

(30) Foreign Application Priority Data

Jul. 10, 2009 (JP) ..... 2009-163760

(51) Int. Cl.
*G03G 15/20* (2006.01)
*G03G 21/20* (2006.01)

(52) U.S. Cl.
USPC ..... 399/341; 399/92

(58) Field of Classification Search
USPC ..... 399/341, 92, 309, 405, 406
See application file for complete search history.

(56) References Cited

U.S. PATENT DOCUMENTS

| | | | | |
|---|---|---|---|---|
| 6,522,841 | B2 * | 2/2003 | Horikoshi | 399/45 |
| 2006/0133865 | A1 * | 6/2006 | Nakamura et al. | 399/320 |
| 2006/0214974 | A1 * | 9/2006 | Isobe et al. | 347/18 |
| 2007/0196152 | A1 | 8/2007 | Shimizu | |

FOREIGN PATENT DOCUMENTS

| | | | |
|---|---|---|---|
| JP | 09022228 | A * | 1/1997 |
| JP | 2007-079310 | A1 | 3/2007 |

* cited by examiner

*Primary Examiner* — Billy J Lactaoen
(74) *Attorney, Agent, or Firm* — Canon U.S.A., Inc. IP Division

(57) ABSTRACT

A guide path branched downward from a conveyance path for guiding a sheet having a toner image fixed thereon to a sheet discharge tray, a switchback path, and an inversed discharge path guide the sheet once, and then guide the sheet to the sheet discharge tray with its front and back surfaces and its leading and trailing edges in a sheet conveyance direction reversed. A fan supplies air between a sheet discharged by a sheet discharge roller and a sheet already discharged onto the sheet discharge tray from a supply opening provided below the sheet discharge roller. A control portion for controlling a blowing operation of the fan selectively operates the fan when discharging the sheet after passing the sheet through the guide path, the switchback path, and the inversed discharge path.

6 Claims, 7 Drawing Sheets

IMAGE FORMING APPARATUS HAVING SHEET COOLING DEVICE

BACKGROUND OF THE INVENTION

1. Field of the Invention

The present invention relates to an image forming apparatus, and more particularly, to driving control of a fan for cooling a sheet.

2. Description of the Related Art

Conventionally, in image forming apparatuses such as a copying machine and a printer for performing image formation using an electrophotographic method, a toner image is transferred onto a sheet, and the sheet is then conveyed to a fixing device to fix the toner image onto the sheet, to form an image on the sheet. Further, some image forming apparatuses include a two-sided image formation mode in which a reversing unit reverses a sheet having an image formed on its front surface, and a re-conveyance portion then conveys the sheet to an image forming portion again to form an image on its back surface, to perform image formation on both the surfaces of the sheet.

In the conventional image forming apparatus, a sheet is discharged onto a sheet discharge tray after the fixing. At that time, the sheet may not be sufficiently cooled. In this case, a phenomenon in which sheets discharged onto the sheet discharge tray are affixed together by fused toner (hereinafter referred to as a blocking phenomenon) may occur.

As this measure, a cooling unit for contacting a sheet with cooling air in a sheet stacking direction, to decrease the temperature of the sheet discharged onto a sheet discharge tray (see U.S. Patent No. 2007/0196152). Alternatively, a fan is operated and stopped, as needed, by disposing the fan above a sheet discharge tray while determining whether stacked sheets are to be air-cooled (see Japanese Patent Application Laid-Open No. 2007-079310).

When thus configured, the image forming apparatus can stop the fan under conditions that no blocking phenomenon occurs on the sheet discharge tray, for example, when the number of stacked sheets is small or a distance between sheets is wide, so that noise and power consumption can be minimized.

FIG. 6 illustrates, in a conventional image forming apparatus in which a fan 402 cools sheets stacked on a sheet discharge tray 310, the flow of air by the fan 402. In the image forming apparatus, a sheet S1 having an image formed on its one surface (first surface) by passing through a fixing device 300 is generally discharged onto the sheet discharge tray 310.

When the sheet S1 is thus discharged onto the sheet discharge tray 310, the fan 402 causes cooling air indicated by an arrow to flow between the discharged sheet S1 and an already discharged sheet Sa, as illustrated in FIG. 6A. The occurrence of a blocking phenomenon in which sheets are affixed together can be prevented by flowing cooling air between the discharged sheet S1 and the already discharged sheet Sa.

In a two-sided image formation mode for forming images on both front and back surfaces of a sheet, an image is formed on a first surface of a sheet S1, and the sheet S1 that has passed through the fixing device 300 is guided into a guide path 301. The sheet S1 guided into the guide path 301 is guided into a reversing path 305 by forward rotation of reversing rollers 302 and 303, and is then fed out in an opposite direction to a direction in which the sheet S1 is fed in with its trailing edge at the head by backward rotation of the reversing roller 303.

The sheet S1 fed out with its leading and trailing edges in a sheet conveyance direction thus reversed is fed to a two-sided conveyance path 306 while being guided by a guiding member (not illustrated), and is then conveyed to an image forming portion again so that a toner image is transferred onto a back surface of the sheet S1. The sheet S1 having the image formed on its back surface by passing through the fixing device 300 is discharged onto the sheet discharge tray 310. The occurrence of a blocking phenomenon can be prevented by flowing cooling air between the sheet S1 thus discharged onto the sheet discharge tray 310 and the already discharged sheet Sa.

The image forming apparatus includes an inversed discharge mode for discharging a sheet that has passed through the fixing device 300 onto the sheet discharge tray 310 with its front and back surfaces and its leading and trailing edges in the sheet conveyance direction reversed. In the inversed discharge mode, the sheet S1 is guided into the guide path 301, then conveyed to an inversed discharge path 307 by backward rotation of the reversing rollers 302 and 303 and switching of the guiding member, and discharged onto the sheet discharge tray 310.

In the conventional image forming apparatus, however, the guide path 301 is branched downward, as illustrated in FIG. 6. Therefore, in the inversed discharge mode, the sheet S1 that has passed through the fixing device 300 passes through the curved guide path 301. In this case, the sheet S1 is curled due to downward curvature of the guide path 301.

When reversed and discharged, the sheet S1 thus curled enters an upward curled state in which its leading and trailing edges in a sheet discharging direction are curved upward in the sheet discharge tray 310 because its front and back surfaces are reversed. When the sheet S1 is discharged onto the sheet discharge tray 310 after passing through the inversed discharge path 307, the sheet S1 is cooled while being affected by the curvature of the guide path 301 immediately after passing through the fixing device 300. Therefore, the sheet S1 is not easily affected by curvature of the inversed discharge path 307.

When the fan 402 causes cooling air to flow between the discharged sheet S1 and the already discharged sheet Sa in this state, cooling air indicated by an arrow flows under a lower surface of the sheet S1 in the upward curled state discharged onto the sheet discharge tray 310, as illustrated in FIG. 6B. Thus, the sheet S1 floats and collides with the subsequent sheet S2. As a result, sheet stacking properties on the sheet discharge tray 310 are deteriorated.

If the guide path 301 is branched upward, the sheet 51 is curled due to upward curvature of the guide path 301. When reversed and discharged, the sheet S1 thus curled enters a downward curled state in which its leading and trailing edges in the sheet discharging direction are curled downward in the sheet discharge tray 310 because its front and back surfaces are reversed.

When the fan 402 causes cooling air to flow between the discharged sheet S1 and the already discharged sheet Sa in this state, the discharged sheet S1 in the downward curled state receives the cooling air at the leading edge in the sheet discharging direction, and thus is conveyed downstream in the sheet discharging direction of a normal sheet discharge position. Therefore, the leading edge in the sheet discharging direction of the sheet S1 hangs from the sheet discharge tray 310 so that the sheet S1 may not be able to return to its proper stacking position by inclination of a stacking face of the sheet discharge tray 310.

If a decurl unit for correcting upper curling and lower curling of the sheet S1 is provided to secure sheet stacking properties, the image forming apparatus increases in size and cost.

SUMMARY OF THE INVENTION

According to an aspect of the present invention, an apparatus includes a fixing unit configured to fix a toner image onto a sheet, a discharge portion configured to discharge the sheet to a sheet stacking portion, a conveyance path configured to guide the sheet to the discharge portion, a reversing path, branched from the conveyance path, configured to reverse the sheet, and then guide to the discharge portion, an opening provided between the discharge portion and the sheet stacking portion to blow air, a blower unit configured to supply the air to the opening, and a control portion configured to control a blowing operation of the blower unit, wherein the control portion operates the blower unit when discharging the sheet from the discharge portion without passing the sheet through the reversing path, and does not operate the blower unit when discharging the sheet after passing the sheet through the reversing path.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
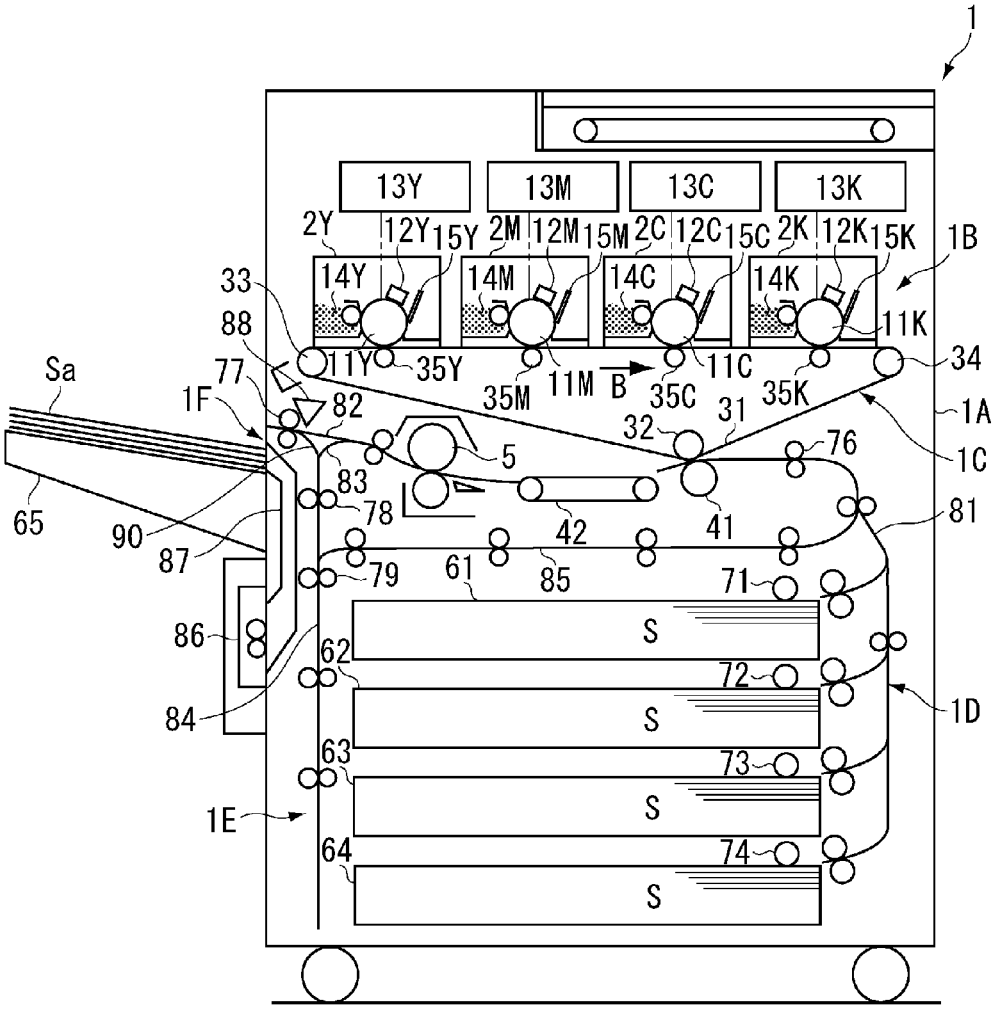
FIG. 1 illustrates a schematic configuration of a color laser printer as an example of an image forming apparatus according to a first exemplary embodiment of the present invention.

FIG. 1 illustrates a schematic configuration of a color laser printer 1 as an example of an image forming apparatus according to a first exemplary embodiment of the present invention.

In FIG. 1, the color laser printer 1 includes a color laser printer main body (hereinafter referred to as a printer main body) 1A. The printer main body 1A includes an image forming portion 1B for forming an image on sheets S, and an intermediate transfer portion 1C, a fixing device 5, and a sheet feeding device 1D for feeding the sheets S to the image forming portion 1B. The color laser printer 1 can form an image on a back surface of the sheet S. Therefore, the printer main body 1A includes a re-conveyance unit 1E for reversing the sheet S having the image formed on its front surface (first surface) and conveying the sheet S to the image forming portion 1B again.

The image forming portion 1B includes four process stations 2 (2Y, 2M, 2C, 2K) arranged in a substantially horizontal direction for respectively forming toner images in four colors, i.e., yellow (Y), magenta (M), cyan (C), and black (Bk). The process stations 2 respectively include photosensitive drums 11 (11Y, 11M, 11C, 11K) serving as image carriers that carry the toner images in four colors, i.e., yellow, magenta, cyan, and black while being driven by a stepping motor (not illustrated).

The process stations 2 respectively include charging devices 12 (12Y, 12M, 12C, 12K) for uniformly charging surfaces of the photosensitive drums 11. The process stations 2 further respectively include exposure devices 13 (13Y, 13M, 13C, 13K) for respectively forming electrostatic latent images on the photosensitive drums 11 that rotate at a predetermined speed by irradiating laser beams based on image information. The process stations 2 further respectively include development devices 14 (14Y, 14M, 14C, 14K) for respectively making toners in yellow, magenta, cyan and black to adhere to the electrostatic latent images formed on the photosensitive drums 11 to develop the toners as toner images. The charging device 12, the exposure device 13, the development device 14, and so on are arranged in a rotational direction around the photosensitive drum 11.

The sheet feeding device 1D is provided in a lower part of the printer main body 1A, and includes sheet cassettes 61 to 64 serving as sheet storage portions for storing the sheets S, and pick-up rollers 71 to 74 for feeding out the sheets S stacked and stored in the sheet cassettes 61 to 64.

When an image forming operation is started, the sheets S are separated and fed one at a time from the sheet cassettes 61 to 64 by the pick-up rollers 71 to 74, and are then conveyed to a registration roller 76 after passing through a conveyance vertical path 81. The registration roller 76 has the function of forming a loop by the sheet S abutting thereon, to correct the skew of the sheet S by aligning its leading edge therewith.

The registration roller 76 further has the function of conveying the sheet S to a secondary transfer portion at timing of image formation on the sheet S, i.e., at predetermined timing in synchronization with a toner image carried on an intermediate transfer belt, described below.

When the sheet S is conveyed, the registration roller 76 is stopped. The sheet S abuts on the stopped registration roller 76 so that the sheet S is deflected. The leading edge of the sheet S is then aligned with a nip of the registration roller 76 by the rigidity of the sheet S so that the skew of the sheet S is corrected.

When the skew of the sheet S is corrected, the registration roller 76 is then driven at timing of matching between the toner image formed on the intermediate transfer belt 31 and the leading edge of the sheet S, as described below.

The intermediate transfer portion 1C includes an intermediate transfer belt 31 that is driven to rotate in a direction in which the process stations 2 are arranged, as indicated by an arrow B, in synchronization with an outer peripheral speed of the photosensitive drum 11. The intermediate transfer belt 31 is stretched around a driving roller 33, a driven roller 32 forming the secondary transfer area with the secondary transfer roller 41 sandwiching the intermediate transfer belt 31 and the secondary transfer roller 41, described below, and a tension roller 34 for applying suitable tension to the intermediate transfer belt 31 by an urging force of a spring (not illustrated).

The intermediate transfer belt 31 includes primary transfer rollers 35 (35Y, 35M, 35C, 35K) for respectively nipping the intermediate transfer belt 31 between the primary transfer rollers 35 and the photosensitive drums 11 and constituting primary transfer portions.

The primary transfer rollers 35 are connected to a transfer bias power supply (not illustrated). Transfer biases are applied to the intermediate transfer belt 31 from the primary transfer rollers 35 so that toner images in respective colors on the photosensitive drums 11 are sequentially multi-transferred onto the intermediate transfer belt 31. Therefore, a full color image is formed on the intermediate transfer belt 31.

The secondary transfer roller 41 is opposed to the driven roller 32. The secondary transfer roller 41 abuts on a lowermost surface of the intermediate transfer belt 31 while nipping the sheet S conveyed by the registration roller 76 between the secondary transfer roller 41 and the intermediate transfer belt 31. When the sheet S passes through a nip portion between the secondary transfer roller 41 and the intermediate transfer belt 31, the toner image on the intermediate transfer belt 31 is secondary-transferred onto the sheet S by applying a bias to the secondary transfer roller 41.

The fixing device 5 constituting the fixing unit fixes the toner image formed on the sheet S via the intermediate transfer belt 31 onto the sheet S. The sheet S having the toner image held thereon is subjected to heat and pressure when passing through the fixing device 5 so that the toner image is fixed on the sheet S.

The image forming operation of the color laser printer 1 thus configured will be described below. When the image forming operation is started, the exposure device 13Y irradiates the photosensitive drum 11Y with a laser beam, to form a yellow latent image on the photosensitive drum 11Y in the process station 2Y arranged on the upperstream side in a rotational direction of the intermediate transfer belt 31.

The development device 14Y then develops the yellow latent image by the yellow toner, to form the yellow toner image. The primary transfer roller 35Y to which a high voltage has been applied primary-transfers the yellow toner image thus formed on the photosensitive drum 11Y onto the intermediate transfer belt 31 in the primary transfer area including the photosensitive drum 11Y and the primary transfer roller 35Y.

The toner image, together with the intermediate transfer belt 31, is then conveyed to the primary transfer area including the photosensitive drum 11M and the primary transfer roller 35M in the subsequent process station 2M in which image formation is delayed by a period of time during which the toner image is conveyed from the process station 2Y.

The subsequent magenta toner image is transferred onto the yellow toner image on the intermediate transfer belt 31 with its leading edge aligned with the leading edge of the yellow toner image. Similar processes are repeated. As a result, the toner images in four colors are primary-transferred onto the intermediate transfer belt 31. Therefore, a full color image is formed on the intermediate transfer belt 31. Photosensitive cleaners 15 (15Y, 15M, 15C, 15K) respectively recover slight residual transfer toners remaining on the photosensitive drums 11, to prepare for the subsequent image formation again.

The sheets S stored in the sheet cassettes 61 to 64, for example, are separated and fed one at a time by the pickup rollers 71 to 74, and are then conveyed to the registration roller 76 in parallel with the toner image forming operation. At this time, the registration roller 76 is stopped. The sheet S abuts on the stopped registration roller 76, to correct the skew of the sheet S.

After the skew of the sheet S is corrected, the registration roller 76 that starts to rotate at timing of matching between the leading edge of the sheet S and the toner image formed on the intermediate transfer belt 31 conveys the sheet S to the nip portion between the secondary transfer roller 41 and the intermediate transfer belt 31. When the sheet S is nipped between the secondary transfer roller 41 and the intermediate transfer belt 31 and conveyed while passing through the nip portion between the secondary transfer roller 41 and the intermediate transfer belt 31, the toner image on the intermediate transfer belt 31 is secondary-transferred onto the sheet S by the bias applied to the secondary transfer roller 41.

A pre-fixing conveyance device 42 conveys the sheet S having the toner image secondary-transferred thereon to the fixing device 5. The fixing device 5 applies a predetermined pressure force by an opposing roller or a belt, and generally a heating effect by a heat source such as a heater, to fuse the toner image to the sheet S.

The main color laser printer 1 has a face-up mode for discharging a sheet having an image formed thereon onto a sheet discharge tray 65 with its image-formed side turned upward, a face-down mode for discharging a sheet with its image-formed side turned downward, and an automatic two-sided mode for forming images on both front and back surfaces of a sheet. A switching member (not illustrated) selects a path to convey a sheet S having a fixed image to a conveyance path 82 in the face-up mode and convey the sheet S having a fixed image to a guide path 83 in the automatic two-sided mode and the face-down mode.

In the face-up mode as one of discharge modes, a sheet discharge roller 77 serving as a discharge portion discharges the sheet S having a fixed image to the sheet discharge tray 65 serving as a sheet stacking portion via the conveyance path 82 serving as a conveyance path. In the automatic two-sided mode as the other discharge mode, a first reversing roller pair 78 and a second reversing roller pair 79 guide the sheet S into a switchback path 84 serving as a reversing path via the guide path 83 branched downward from the conveyance path 82.

A switchback operation for switching the second reversing roller pair 79 from forward rotation to backward rotation is then performed so that the sheet S is conveyed to a two-sided conveyance path 85 with its leading and trailing edges reversed. Then, the sheet S is joined into the conveyance vertical path 81 at the same timing as a sheet S in the subsequent job conveyed by the pick-up rollers 71 to 74, and is similarly fed to the secondary transfer area via the registration roller 76.

The subsequent image forming process for the back surface (second surface) of the sheet S is similar to that for the front surface (first surface) thereof described above. In the face-down mode as an inversed discharge mode in which the sheet S is reversed and discharged, the sheet S that has passed through the fixing device 5 is discharged onto the sheet discharge tray 65 with its front and back surfaces and its leading and trailing edges in a sheet conveyance direction reversed.

When the face-down mode is selected, therefore, the sheet S that has passed through the fixing device 5 is guided into the switchback path 84 by forward rotation of the first reversing roller pair 78 and the second reversing roller pair 79 from the curved guide path 83. The guided sheet S is conveyed in an opposite direction to a direction in which it is fed in with its trailing edge at the head and fed into the inversed discharge path 90 by backward rotation of the first reversing roller pair 78 and the second reversing roller pair 79, and is discharged onto the sheet discharge tray 65 by the sheet discharge roller 77.

In the present exemplary embodiment, the guide path 83, the switchback path 84, and the inversed discharge path 90 constitute a reversing path for guiding the sheet S having the toner image fixed thereon once, and then guiding the sheet S to the sheet discharge tray 65 with its front and back surfaces and its leading and trailing edges in the sheet conveyance direction reversed.

In FIG. 1, a sheet discharge sensor 88 is provided upstream in the sheet conveyance direction of the sheet discharge roller 77. The sheet discharge sensor 88 is provided at a position where the sheet S that has not been discharged onto the sheet discharge tray 65 can be detected in any one of the face-up mode, the face-down mode, and the automatic two-sided mode.

In the present exemplary embodiment, the sheet discharge sensor 88 detects, when the sheet S passes therethrough, the leading edge of the sheet S by a detection member (not illustrated) moving to shield a photointerrupter (not illustrated). In FIG. 1, a fan 86 serves as a blower unit provided below the sheet discharge tray 65 for sucking in air outside the printer main body 1A.

The fan 86 blows the suctioned air into a duct 87 installed in the printer main body 1A, and blows the air toward the sheet S on the sheet discharge tray 65 from an opening 1F formed between the sheet discharge roller 77 and the sheet discharge tray 65. The air from the opening 1F is supplied between the discharged sheet S and an already discharged sheet Sa. Therefore, a blocking phenomenon can be prevented from occurring.

Figure 2:
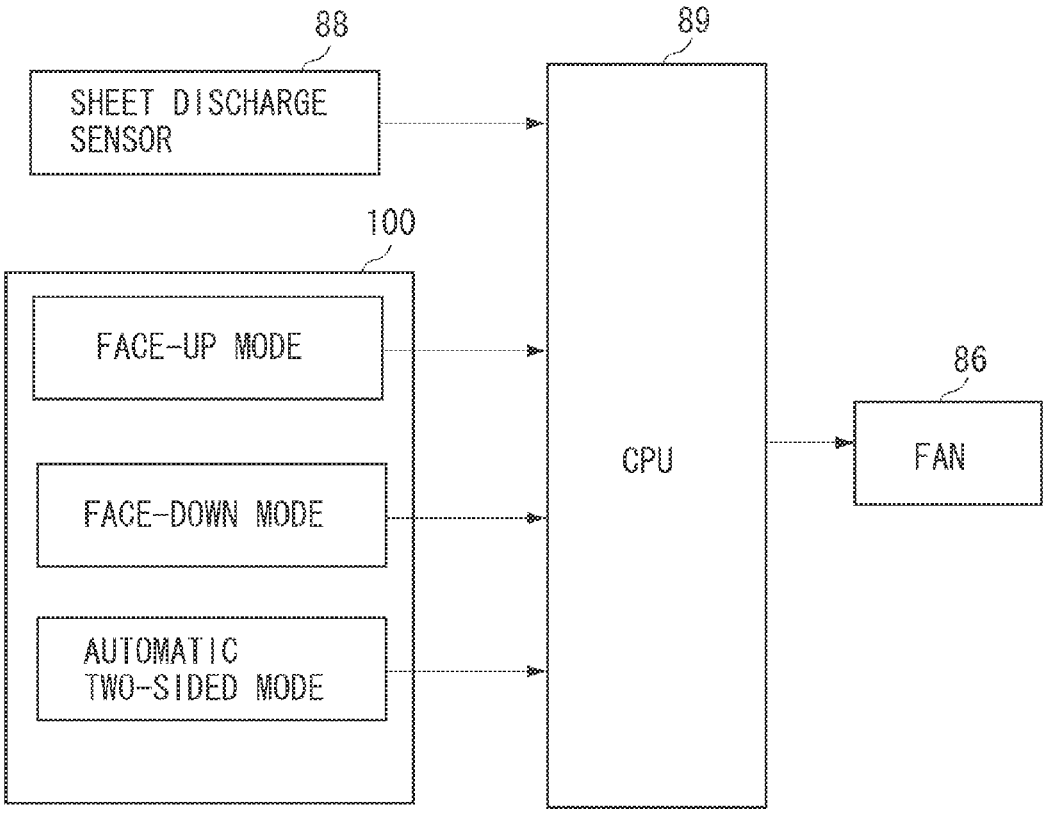
FIG. 2 is a control block diagram of the color laser printer.

FIG. 2 is a control block diagram of the color laser printer 1. An operation portion 100 arranged on an upper surface of the printer main body 1A, for example, the sheet discharge sensor 88, and the fan 86 are connected to a central processing unit (CPU) (control portion) 89 provided at a predetermined position of the printer main body 1A. A face-up mode signal, a face-down mode signal, and an automatic two-sided mode signal are input to the CPU 89 from the operation portion 100 or an external personal computer (PC) (not illustrated).

The CPU 89 selectively drives the fan 86 according to the input mode, to control a blowing operation. In the face-down mode, a sheet S passes through the switchback path 84 and the inversed discharge path 90, so that a conveyance distance from the fixing device 5 to the sheet discharge tray 65 becomes longer than that in the face-up mode and the automatic two-sided mode. As a result, a self-cooling effect is enhanced.

Therefore, even if the fan 86 does not cool the sheet S, no blocking phenomenon occurs. Thus, the CPU 89 does not operate and stops the fan 86 when the input mode is the face-down mode in the present exemplary embodiment.

In the face-down mode, the fan 86 is not thus operated so that the sheet S does not float even if it is curled upward due to the effect of the guide path 83 curved downward just behind the fixing device 5. Therefore, sheet stacking properties are not deteriorated.

Figure 3:
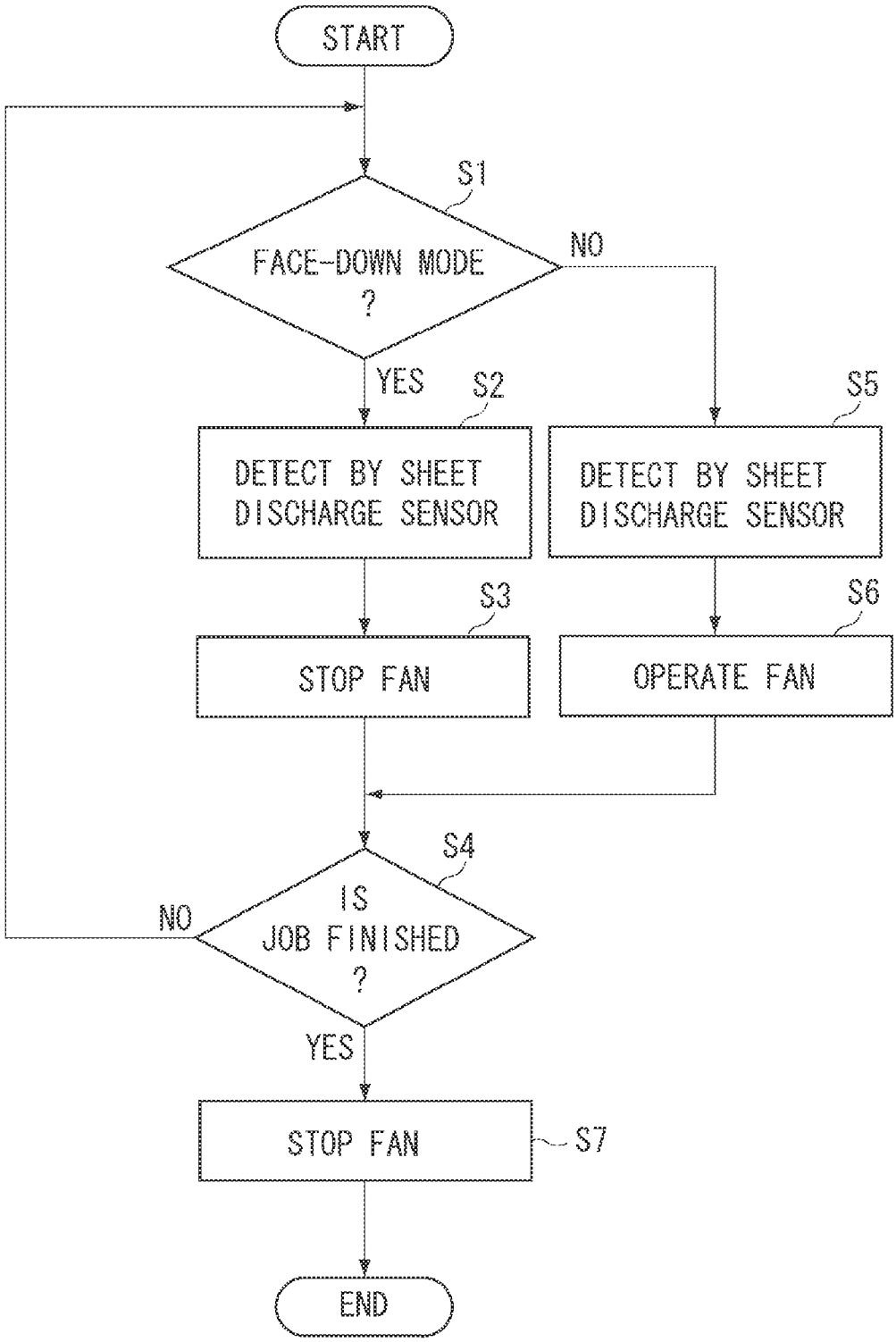
FIG. 3 is a flowchart illustrating operation control of a fan in the color laser printer.

Operation control of the fan 86 in the present exemplary embodiment will be described below with reference to a flowchart illustrated in FIG. 3.

First, an image is formed on one surface of a sheet S, and the sheet S is discharged in a face-up mode. In this case, if an image formation job is started, the processing proceeds to step S1. In step S1, the CPU 89 recognizes whether a mode previously designated by the operation portion 100 or an external PC (not illustrated) is a face-down mode.

If the face-up mode is designated, i.e., the designated mode is not the face-down mode (NO in step S1), the sheet S is then conveyed, and the processing proceeds to step S5. In step S5, the CPU 89 causes the sheet discharge sensor 88 to detect the leading edge of the sheet S. In step S6, the CPU operates the fan 86. Thus, air is supplied between the discharged sheet S and the already discharged sheet Sa from the opening 1F. Therefore, a blocking phenomenon can be prevented from occurring.

In step S4, the CPU 89 then determines whether the job is terminated. If the job is not terminated (NO in step S4), the processing returns to step S1. If the face-up mode is designated for second and subsequent sheets, the CPU 89 continues to operate the fan 86. If the job is terminated (YES in step S4), the processing proceeds to step S7. In step S7, the CPU 89 stops the fan 86.

An automatic two-sided mode in which images are formed on both surfaces of a sheet S will be described below.

If the automatic two-sided mode is designated, i.e., the designated mode is not the face-down mode (NO in step S1), an image is formed on a second surface of the sheet S, as described above, and the processing proceeds to step S5. In step S5, the CPU 89 causes the sheet discharge sensor 88 to detect the leading edge of the sheet S. In step S6, the CPU 89 operates the fan 86. If the automatic two-sided mode is designated for the second and subsequent sheets, the CPU 89 continues to operate the fan 86. If the job is terminated (YES in step S4), the processing proceeds to step S7. In step S7, the CPU 89 stops the fan 86.

On the other hand, if the designated mode is the face-down mode (YES in step S1), the processing proceeds to step S2. In step S2, the CPU 89 causes the sheet discharge sensor 88 to detect the leading edge of the conveyed sheet S. In step S3, the CPU 89 does not operate ant stops the fan 86. In step S4, the CPU 89 then determines whether the job is terminated. If the job is not terminated (NO in step S4), the processing returns to step S1. If the face-down mode is designated for the second and subsequent sheets, the CPU 89 stops the fan 86 in step S3.

In the present exemplary embodiment, the face-up mode, the face-down mode, and the automatic two-sided mode may be mixed in one job. For example, the face-up mode, the face-down mode, and the automatic two-sided mode may be respectively designated for the first sheet, the second sheet, and the third sheet.

In this case, if the designated mode is not the face-down mode for the first sheet (NO in step S1), the processing proceeds to step S5. In step S5, the CPU 89 causes the sheet discharge sensor 88 to detect the leading edge of the first sheet. In step S6, the CPU 89 operates the fan 86. If the designated mode is the face-down mode for the second sheet (YES in step S1), the processing proceeds to step S2. In step S2, the CPU 89 causes the sheet discharge sensor 88 to detect the leading edge of the second sheet. In step S3, the CPU 89 stops the fan 86.

If the automatic two-sided mode is designated for the third sheet, i.e., the designated mode is not the face-down mode for the third sheet (NO in step S1), the processing proceeds to step S5. In step S5, the CPU 89 causes the sheet discharge sensor 88 to detect the leading edge of the third sheet. In step S6, the CPU 89 operates the fan 86. For fourth and subsequent sheets, the CPU 89 operates or stops the fan 86 according to the mode. If the job is terminated (YES in step S4), the processing proceeds to step S7. In step S7, the CPU 89 stops the fan 86.

As described above, in the present exemplary embodiment, the CPU 89 performs control to operate the fan 86 in the face-up mode and the automatic two-sided mode as discharge modes, and to stop the fan 86 in the face-down mode as an inversed discharge mode. Such control enables sheet stacking properties to be secured while preventing a blocking phenomenon in all the modes.

The present invention is also effective in a configuration in which the guide path 83 just behind the fixing device 5 is curved upward. Even if the sheet S is curled downward due to the effect of the guide path 83 curved upward just behind the fixing device 5, the sheet S does not jump too far because the fan 86 is stopped. Therefore, sheet stacking properties are not deteriorated.

Figure 4:
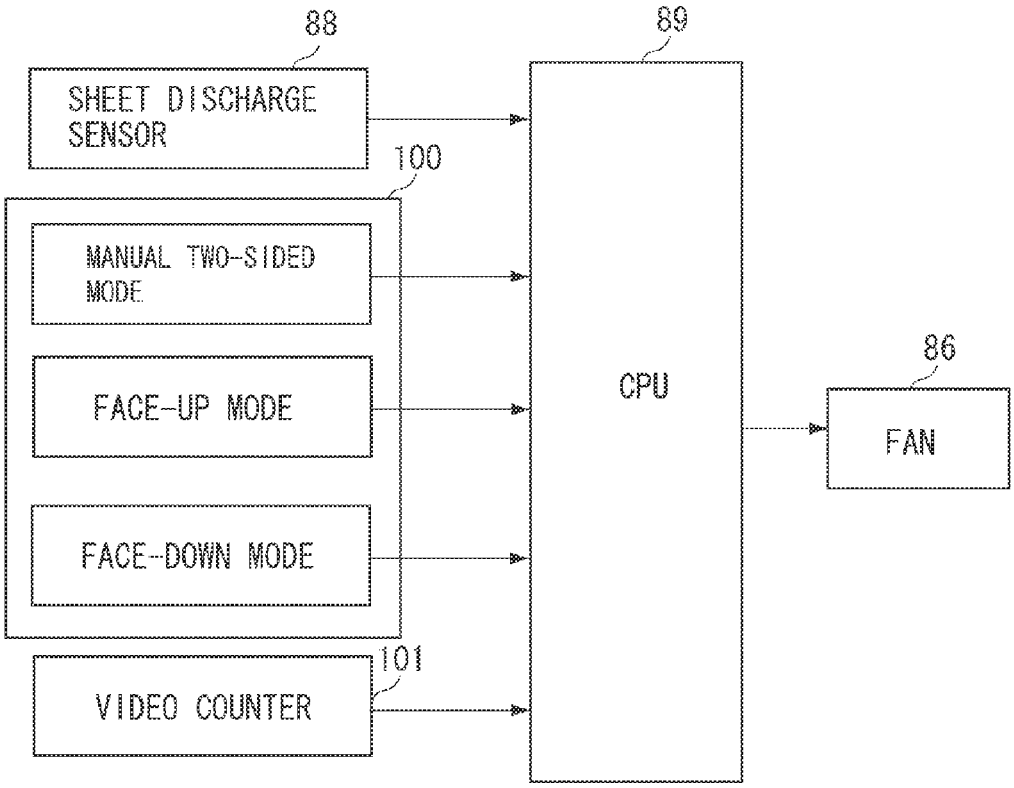
FIG. 4 is a control block diagram of an image forming apparatus according to a second exemplary embodiment of the present invention.

A second exemplary embodiment of the present invention will be described below. FIG. 4 is a control block diagram of an image forming apparatus according to the present exemplary embodiment. In FIG. 4, the same reference numerals as those illustrated in FIG. 2 denote similar or corresponding units.

In the present exemplary embodiment, the image forming apparatus includes a manual two-sided mode as a back-side mode for forming an image on a back surface (second surface) of a sheet having an image already formed on its one surface (first surface). When the manual two-sided mode is designated, a user sets a sheet S with a surface on which an image has already been formed turned upward in a sheet storage portion in the image forming apparatus.

A user sets the manual two-sided mode through the operation portion 100. In the manual two-sided mode, the image has already been formed on the one surface of the sheet S. When the sheet S is discharged in a face-down mode for ordering sheets by page, therefore, if the amount of toner in an image newly formed on a back surface of the sheet S is large, the image newly formed and an image formed on one surface of a sheet already stacked may be easily affixed together.

More specifically, even in the face-down mode, if the amount of toner in the image formed on the sheet S in the manual two-sided mode is large, a blocking phenomenon may easily occur between the surface, on which the image has been formed, of the sheet S in the manual two-sided mode and the surface, on which the image has been formed, of the already stacked sheet. In the present exemplary embodiment, if the amount of toner in the image formed in the manual two-sided mode is large, a fan 86 is operated.

In the present exemplary embodiment, a video counter 101 counts the number of dots to which toner in image data adheres, to determine the amount of toner in the formed image based on its count value (a video count value A). When image data includes portions represented by data 1 developed by toner and portions represented by data 0 not developed, for example, the video count value A is the sum of the portions represented by data 1.

If a video count value A for a first sheet is less than a previously set value a1, no blocking phenomenon occurs. Even if a sheet discharge sensor 88 detects the leading edge of the sheet S, therefore, the fan 86 is not operated. On the other hand, if the video count value A for the first sheet is the previously set value a1 or more, a blocking phenomenon easily occurs. When the sheet discharge sensor 88 detects the leading edge of the sheet S, the fan 86 is operated.

If the amount of toner is large, an image-formed side of the sheet S tends to be contracted by the toner. A direction of the contraction is an opposite direction to a direction in which the sheet S is curled when passing through a guide path 83. Thus, the sheet S is not easily curled. If the amount of toner is large, the weight of the sheet S is also increased. Therefore, even if the fan 86 is operated, the discharged sheet S does not float. Accordingly, even if the fan 86 is operated, sheet stacking properties are not deteriorated. Therefore, a blocking phenomenon can be prevented.

Figure 5:
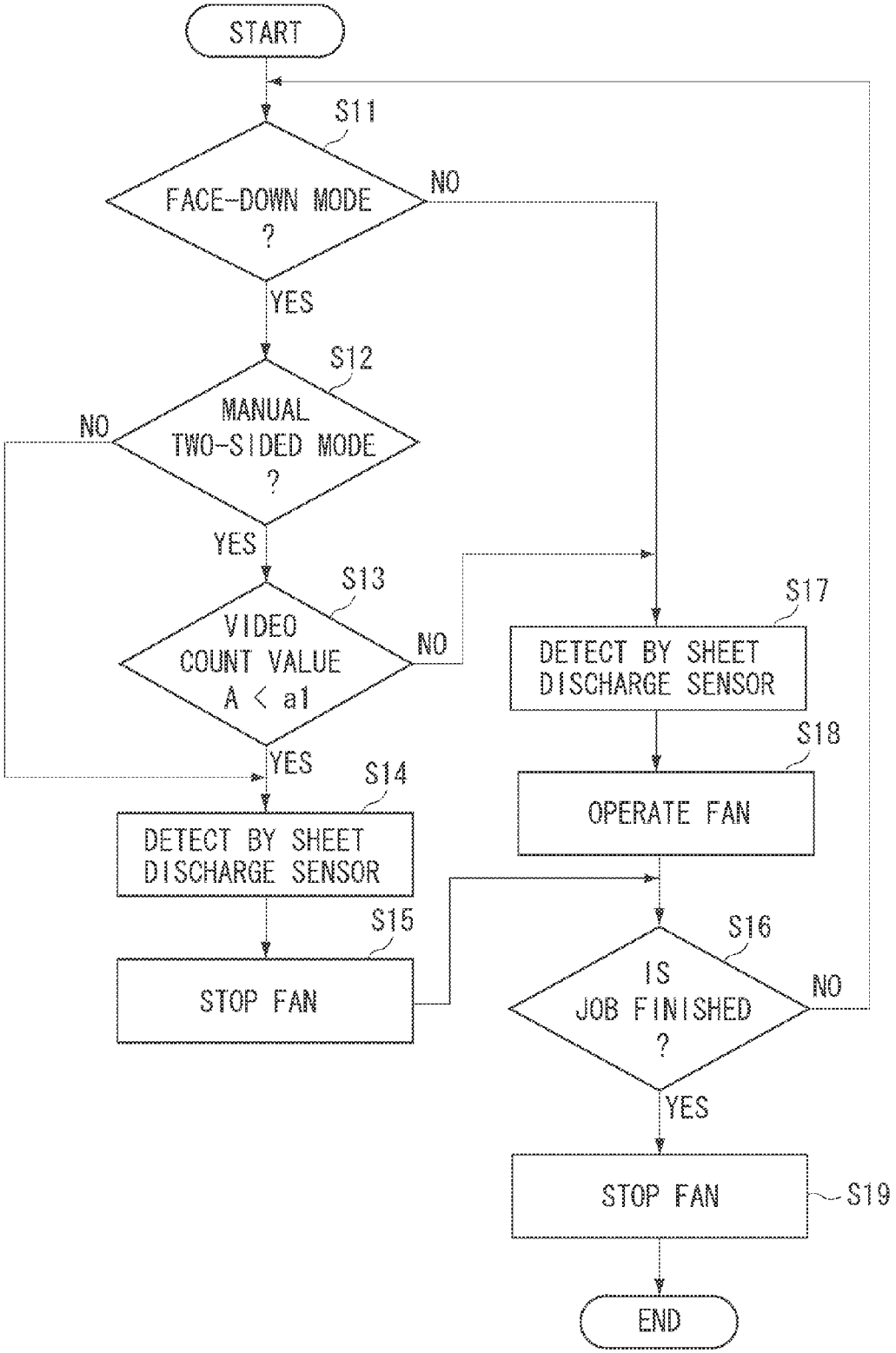
FIG. 5 is a flowchart illustrating operation control of a fan in the image forming apparatus.
Figure 6A:
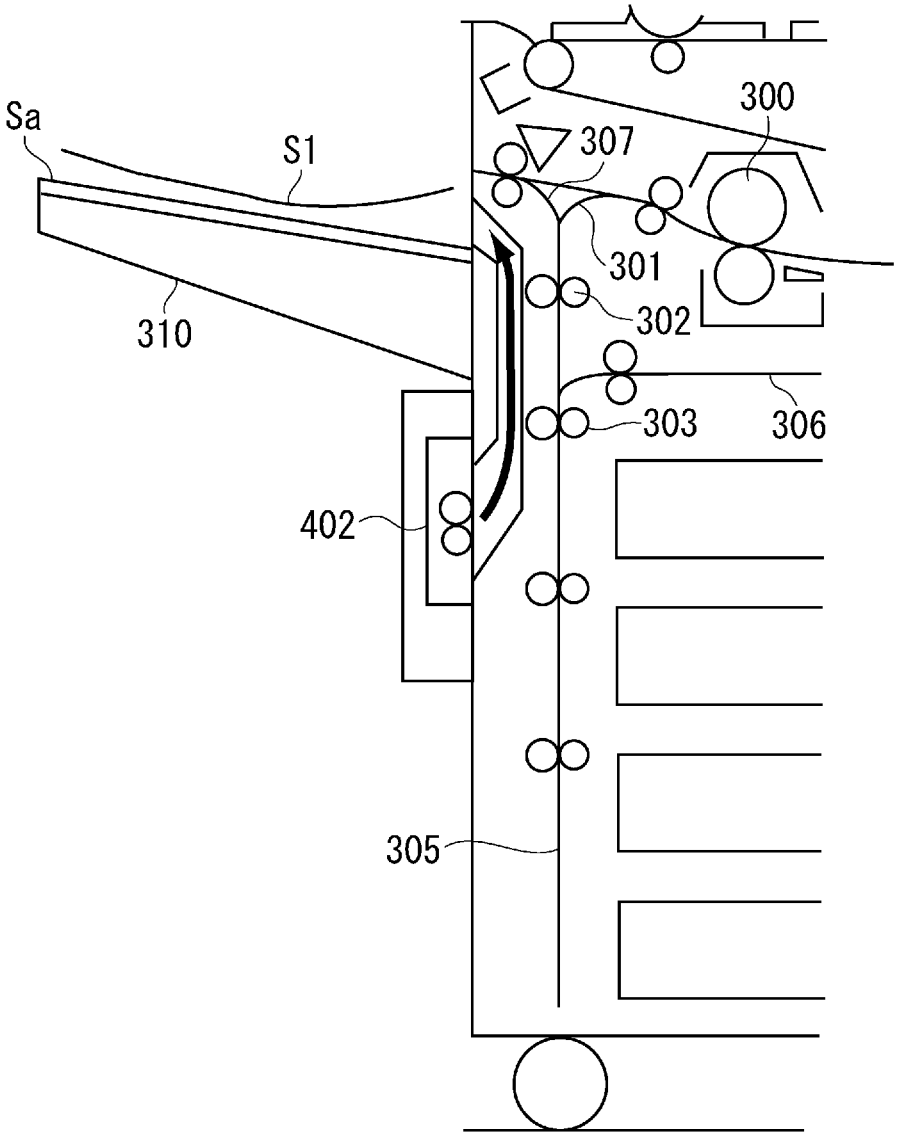
FIG. 6 illustrates the flow of air by a fan in a conventional image forming apparatus.
Figure 6B:
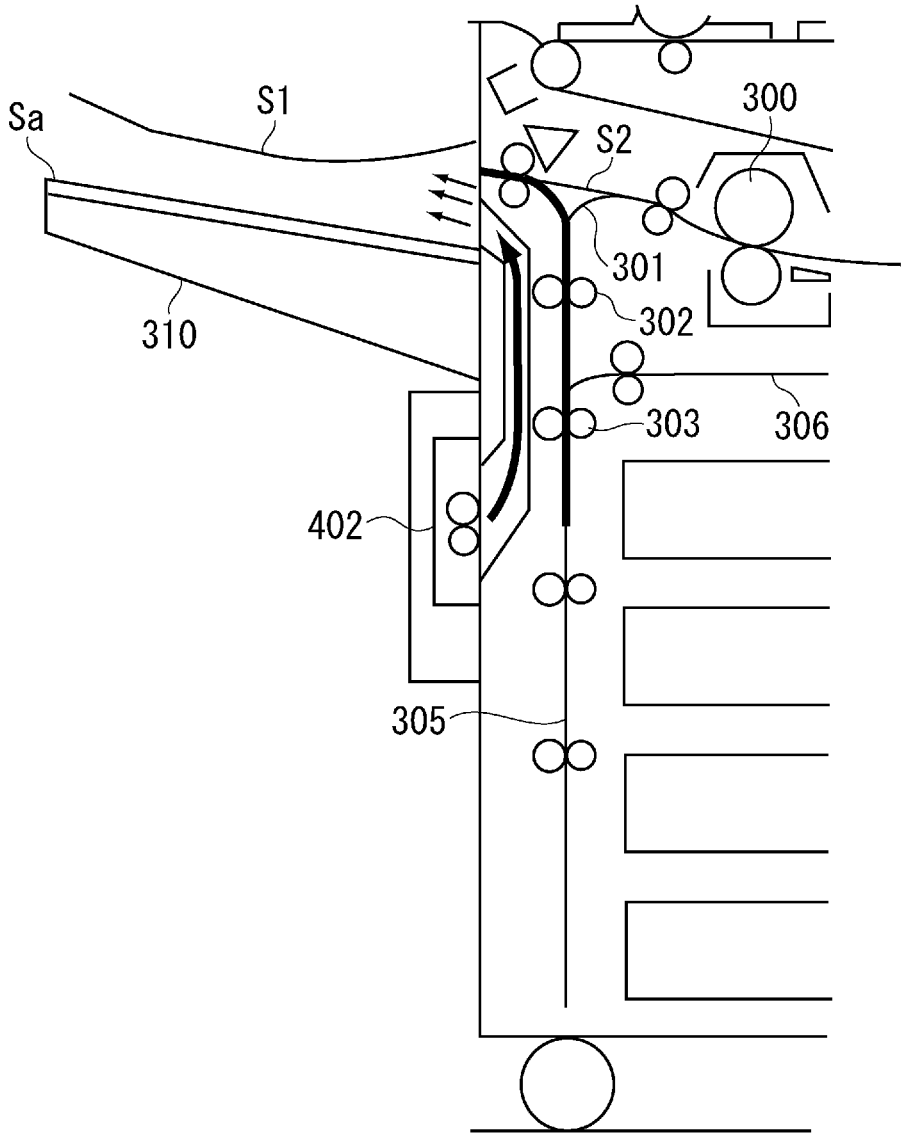

Operation control of the fan 86 in the present exemplary embodiment will be described below with reference to a flowchart illustrated in FIG. 5. First, a sheet S having an image formed on its one surface is discharged after an image is formed on a back surface of the sheet S in a face-up mode in which a surface on which an image is newly formed turned upward on a sheet discharge tray 65.

In this case, if an image formation job is started, the processing proceeds to step S11. In step S11, the CPU 89 recognizes whether a mode previously designated by the operation portion 100 or an external PC (not illustrated) is a face-down mode. If a face-up mode is designated, i.e., the designated mode is not the face-down mode (NO in step S11), the sheet S is then conveyed, and the processing proceeds to step S17. In step S17, the CPU 89 causes the sheet discharge sensor 88 to detect the leading edge of the sheet S. In step S18, the CPU operates the fan 86.

In step S16, the CPU 89 then determines whether the job is terminated. If the job is not terminated (NO in step S16), the processing returns to step S1. If the face-up mode is designated for second and subsequent sheets, the CPU 89 continues to operate the fan 86. If the job is terminated (YES in step S16), the processing proceeds to step S19. In step S19, the CPU 89 stops the fan 86.

Then, the sheet S is discharged in the face-down mode in which its surface on which an image is newly formed is turned downward on the sheet discharge tray 65. In this case, i.e., if the designated mode is the face-down mode (YES in step S11), the processing proceeds to step S12. In step S12, the CPU 89 determines whether a manual two-sided mode is designated.

If the manual two-sided mode is designated (YES in step S12), the video counter 101 serving as a toner amount detection portion detects the amount of toner in the image newly formed on the surface of the sheet S, and the processing proceeds to step S13. In step S13, the CPU 89 determines whether a video count value A for the first sheet that is detection information from the video counter 101 is less than a previously set value a1. If the video count value A is less than the previously set value a1 (YES in step S13), the processing proceeds to step S14. In step S14, the CPU 89 causes the sheet discharge sensor 88 to detect the leading edge of the sheet S. In step S15, the CPU 89 does not operate the fan 86.

On the other hand, if the video count value A for the first sheet is the previously set value a1 or more (NO in step S13), the processing proceeds to step S17. In step S17, the CPU 89 causes the sheet discharge sensor 88 to detect the leading edge of the sheet S. In step S18, the CPU 89 selectively operates the fan 86. If the designated mode is the face-down mode for the second and subsequent sheets (YES in step S11), and the manual two-sided mode is designated (YES in step S12), the CPU 89 controls the operation and the stop of the fan 86 according to the video count value A. If the job is terminated (YES in step S16), the CPU 89 stops the fan 86 in step S19.

If the manual two-sided mode is not designated (NO in step S12), the CPU 89 causes the sheet discharge sensor 88 to detect the leading edge of the sheet S in step S14, and the CPU 89 stops the fan 86 in step S15, like in the first exemplary embodiment described above.

As described above, in the present exemplary embodiment, even if the designated mode is the face-down mode, if the manual two-sided mode is selected, and the amount of toner in the image newly formed on the back surface of the sheet S exceeds a predetermined amount, the CPU operates the fan 86. This enables sheet stacking properties to be secured while preventing a blocking phenomenon (affixing of sheets).

Although control performed when the manual two-sided mode is selected has been described in the present exemplary embodiment, the present invention is also effective in an automatic two-sided mode for continuously forming images on front and back surfaces of a sheet. When the automatic two-sided mode is selected, and sheets are reversed and discharged to order the sheets by page, if the amount of toner in an image newly formed on the back surface of the sheet exceeds a predetermined amount, a blocking phenomenon (affixing of sheets) can be prevented by applying the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-163760 filed Jul. 10, 2009, which is hereby incorporated by reference herein in its entirety.

What is claimed is:

1. An apparatus comprising:

a fixing unit configured to fix a toner image onto a sheet;

a discharge portion configured to discharge the sheet to a sheet stacking portion from inside of a main body of the apparatus;

a conveyance path configured to guide the sheet to the discharge portion;

a reversing path, branched from the conveyance path, configured to reverse the sheet, and then guide the sheet to the discharge portion;

an opening provided between the discharge portion and the sheet stacking portion;

a blower unit configured to blow out air through the opening from the inside of the main body of the apparatus; and a control portion configured to control a blowing operation of the blower unit so that the blower unit blows out air from the opening when the sheet, without passing through the reversing path, is discharged to the sheet stacking portion, and the blower unit does not blow out air from the opening when the sheet, after passing through the reversing path to reverse the sheet, is discharged to the sheet stacking portion.

2. The apparatus according to claim 1, wherein when passing a sheet having an image already formed on its one surface through the reversing path after forming an image on a back surface of the sheet, and discharging the sheet with the back surface directed toward the sheet stacking portion, the control portion operates the blower unit if an amount of toner in the image formed on the back surface exceeds a predetermined value.

3. The apparatus according to claim 2, further comprising:

a toner amount detection portion configured to obtain an amount of the toner by counting image data developed by the toner, wherein the control portion performs control to operate the blower unit based on detected information from the toner amount detection portion.

4. A method comprising:

fixing a toner image onto a sheet;

discharging the sheet to a sheet stacking portion by a discharge portion from inside of a main body of the apparatus;

guiding the sheet to the discharge portion by passing a conveyance path;

reversing the sheet by passing a reverse path branched from the conveyance path to reverse the sheet, and then guiding to the discharge portion;

blowing out air by a blower unit from the inside of the main body of the apparatus through an opening provided between the discharge portion and the sheet stacking portion; and controlling a blowing operation of the blower unit by a control portion so that the blower unit blows out air from the opening when the sheet, without passing through the reversing path, is discharged the sheet stacking portion, and the blower unit does not blow out air from the opening when the sheet, after passing through the reversing path to reverse the sheet, is discharged to the sheet stacking portion.

5. The method according to claim 4, wherein when passing a sheet having an image already formed on its one surface through the reversing path after forming an image on a back surface of the sheet, and discharging the sheet with the back surface directed toward the sheet stacking portion, the control portion operates the blower unit if an amount of toner in the image formed on the back surface exceeds a predetermined value.

6. The method according to claim 5, further comprising:

obtaining an amount of the toner by counting developed image by a toner amount detection portion, wherein the control portion performs control to operate the blower unit based on detected information from the toner amount detection portion.

* * * * *